US007063435B2

(12) United States Patent
Dallas et al.

(10) Patent No.: US 7,063,435 B2
(45) Date of Patent: Jun. 20, 2006

(54) POCKET TOOL WITH FLASHLIGHT

(75) Inventors: Edgar A. Dallas, Beaverton, OR (US); John A. Nason, Keizer, OR (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

(21) Appl. No.: 10/716,387

(22) Filed: Nov. 18, 2003

(65) Prior Publication Data

US 2005/0105286 A1 May 19, 2005

(51) Int. Cl.
*B26B 11/00* (2006.01)
*B26B 1/02* (2006.01)
*B25B 23/18* (2006.01)

(52) U.S. Cl. ..... 362/119; 362/184; 362/800; 30/123; 30/142

(58) Field of Classification Search ..... 362/119, 362/120, 184, 800, 228, 240, 236, 157, 200, 362/205, 208; 30/142, 123; D8/99; D26/38; D22/118
See application file for complete search history.

(56) References Cited

U.S. PATENT DOCUMENTS 1,692,394 A 11/1928 Sundh
2,467,954 A 4/1949 Becker
2,648,762 A 8/1953 Dunkelberger
D173,323 S * 10/1954 Polk ..... D8/99
3,103,723 A 9/1963 Becker
3,111,277 A 11/1963 Grimsley
3,370,163 A * 2/1968 Brill ..... 362/119
3,393,312 A 7/1968 Dahl
4,364,104 A 12/1982 Holahan et al.
4,495,550 A 1/1985 Visciano
4,751,621 A * 6/1988 Jenkins ..... 362/119
5,136,477 A 8/1992 Lemmey
5,154,483 A 10/1992 Zeller
5,313,376 A * 5/1994 McIntosh ..... 362/119
D350,271 S * 9/1994 Landy et al. ..... D8/99
D353,011 S * 11/1994 Miller ..... D8/99
5,369,556 A 11/1994 Zeller
5,385,500 A 1/1995 Schmidt
5,402,575 A * 4/1995 Maxcy ..... 30/123
5,467,256 A * 11/1995 Chen ..... 362/119
5,517,392 A 5/1996 Rousso et al.
5,521,803 A 5/1996 Eckert et al.
5,571,279 A 11/1996 Chiang
5,626,414 A * 5/1997 Chen ..... 362/119
5,707,137 A 1/1998 Hon
5,716,121 A 2/1998 Dubois
5,727,319 A * 3/1998 Myerchin et al. ..... 30/123
5,765,938 A 6/1998 Rousso et al.
5,806,961 A * 9/1998 Dalton et al. ..... 362/184
5,829,329 A 11/1998 Frazer
5,916,277 A * 6/1999 Dallas ..... 30/143

(Continued)

FOREIGN PATENT DOCUMENTS

DE 203 08 783 U1 10/2003

(Continued)

*Primary Examiner*—Timothy V Eley
*Assistant Examiner*—Jason Prone
(74) *Attorney, Agent, or Firm*—Foley & Lardner LLP

(57) ABSTRACT

A pocket tool includes a handle and at least one ancillary tool coupled to the handle. In an exemplary embodiment, a flashlight is coupled to the handle, the flashlight having a first light source directed in a first direction and a second light source directed in a second direction. In another embodiment, the pocket tool may include means for biasing the flashlight into the open position.

18 Claims, 3 Drawing Sheets

U.S. PATENT DOCUMENTS

D412,355 S * 7/1999 Sætherbo ..... D22/118
5,957,013 A 9/1999 Frazer
5,971,562 A * 10/1999 Yang ..... 362/184
6,000,809 A 12/1999 Belo
6,027,224 A 2/2000 Schnell
6,044,560 A * 4/2000 Chao ..... 30/123
6,099,141 A * 8/2000 Landamia ..... 362/184
6,158,874 A 12/2000 Brustein et al.
6,162,137 A * 12/2000 Jones et al. ..... 30/109
6,186,638 B1 2/2001 Chang
6,231,207 B1 5/2001 Kennedy et al.
6,260,453 B1 7/2001 Anderson et al.
6,273,582 B1 8/2001 Taggart et al.
6,280,050 B1 8/2001 Bird et al.
6,305,819 B1 * 10/2001 Chen ..... 362/184
6,341,423 B1 * 1/2002 Taggart et al. ..... 30/143
6,366,028 B1 4/2002 Wener et al.
6,386,727 B1 5/2002 Yeh
6,434,829 B1 * 8/2002 Chen ..... 30/123
6,454,427 B1 * 9/2002 Chen ..... 362/208
D481,289 S * 10/2003 Dallas ..... D8/105
2002/0105796 A1 * 8/2002 Naghi et al. ..... 362/120
2003/0028973 A1 * 2/2003 Johnson et al. ..... 7/160
2004/0141313 A1 * 7/2004 Elsener ..... 362/119
2004/0187313 A1 * 9/2004 Zirk et al. ..... 30/123
2004/0211007 A1 * 10/2004 Ping ..... 7/128

FOREIGN PATENT DOCUMENTS

EP 1 081 425 A2 3/2001
WO WO 99/67060 A1 12/1999

* cited by examiner

POCKET TOOL WITH FLASHLIGHT

FIELD OF THE INVENTION

The present invention relates to a pocket tool having a flashlight. In particular, the present invention relates to a pocket tool having a number of folding ancillary tools and a spring activated flashlight that may be automatically activated upon deployment.

BACKGROUND OF THE INVENTION

Pocket tools such as folding knives typically include a handle and one or more ancillary tools, such as a blade, pivotally attached to the handle. The ancillary tools have a compact, closed position and an extended, open position and may have the capability of being locked into the open position. A user opens an ancillary tool by grasping the tool or pushing a knob protruding from the tool in order to rotate the tool into the open position.

Due to the many features available on such pocket tools, such as knives, screwdrivers, scissors and the like, many users carry such a tool at all times and use it under many conditions. One such condition may be in low light conditions in which it would be desirable to have a flashlight attached to the pocket tool. One such design is shown in U.S. Pat. No. 5,916,277 to Dallas.

One challenge presented by current pocket tools having a light source is that the light source is not well suited to light the ancillary tool that is in use. Even if the light source is oriented to shine in the direction of the ancillary tool, it may be obscured by the user's hand, thus reducing the effectiveness of the light source.

Another design challenge presented by a pocket tool having a flashlight is the efficiency of opening and activating the flashlight. It is advantageous to have the flashlight stowed in the pocket tool handle when not in use so that the tool may be more efficiently carried. However, when the flashlight is desired, a user may wish to easily and quickly activate the flashlight. Conventional approaches requiring the user to manually unfold the flashlight from the handle and further activate a switch to turn on the flashlight are time consuming and may be awkward if the user is already engaged in utilizing one of the other ancillary tools.

Another challenge presented in the design of a pocket tool with a flashlight is providing light to all desired areas, especially if those areas are not proximate to one another. Typical flashlight designs have a single bulb that only directs light in a single direction when activated.

Accordingly, there is a need for a pocket tool that includes a light source that may be efficiently deployed and activated. Further, there is a need for a light source that is configured to shine in the desired direction without being obscured by the user's hand or other portions of the tool. Further still, there is a need for a light source on a pocket tool that is configured to light multiple areas when activated.

It would be desirable to provide a system and/or method that provides one or more of these or other advantageous features. Other features and advantages will be made apparent from the present specification. The teachings disclosed extend to those embodiments that fall within the scope of the appended claims, regardless of whether they accomplish one or more of the aforementioned needs.

SUMMARY OF THE INVENTION

The invention relates to a pocket tool having a handle and at least one ancillary tool coupled to the handle. A flashlight is coupled to the handle and the flashlight has a first light source directed in a first direction and a second light source directed in a second direction.

The invention further relates to a pocket tool having a handle, an ancillary tool coupled to the handle, and a flashlight coupled to the handle. The flashlight has a closed position and an open position. The tool further has a means for biasing the flashlight into the open position, coupled between the handle and the flashlight, and a means for activating the flashlight. The means for activating the flashlight moves the flashlight from the closed position to the open position and turns the flashlight on when activated.

The invention further relates to a flashlight having a handle and a lighting unit coupled to the handle. A first light source is coupled to the lighting unit and directs a first light beam in a first direction. A second light source is also coupled to the lighting unit, the second light source directing a second light beam in a second direction.

The invention is capable of other embodiments and of being practiced or being carried out in various ways. Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF PREFERRED EMBODIMENTS

Figure 1:
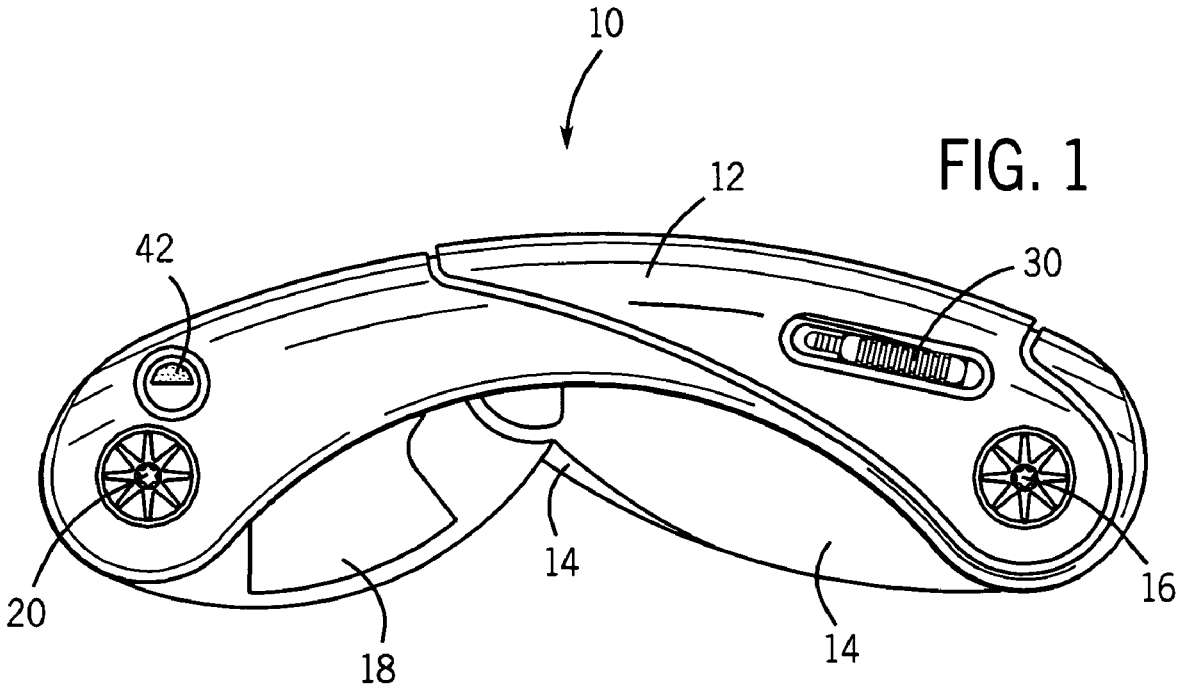
FIG. 1 is an elevation view of a pocket tool in a compact configuration.

Referring to FIG. 1, a pocket tool or multi-function tool, shown as pocket tool 10, includes a handle 12 to which various ancillary tools 14 are pivotally attached. The handle 12 may be made of a rigid glass-filled nylon with a Sanoprene overmold. In an exemplary embodiment, the handle has an interior channel and several ancillary tools 14 are pivotally attached to the handle 12 by an axle 16 permitting the tools 14 to be folded outward into an open position or into a closed position received within the handle 12. In the embodiment depicted in FIG. 1, a flashlight 18 is also pivotally connected to the handle 12 by an axle 20.

Figure 2:
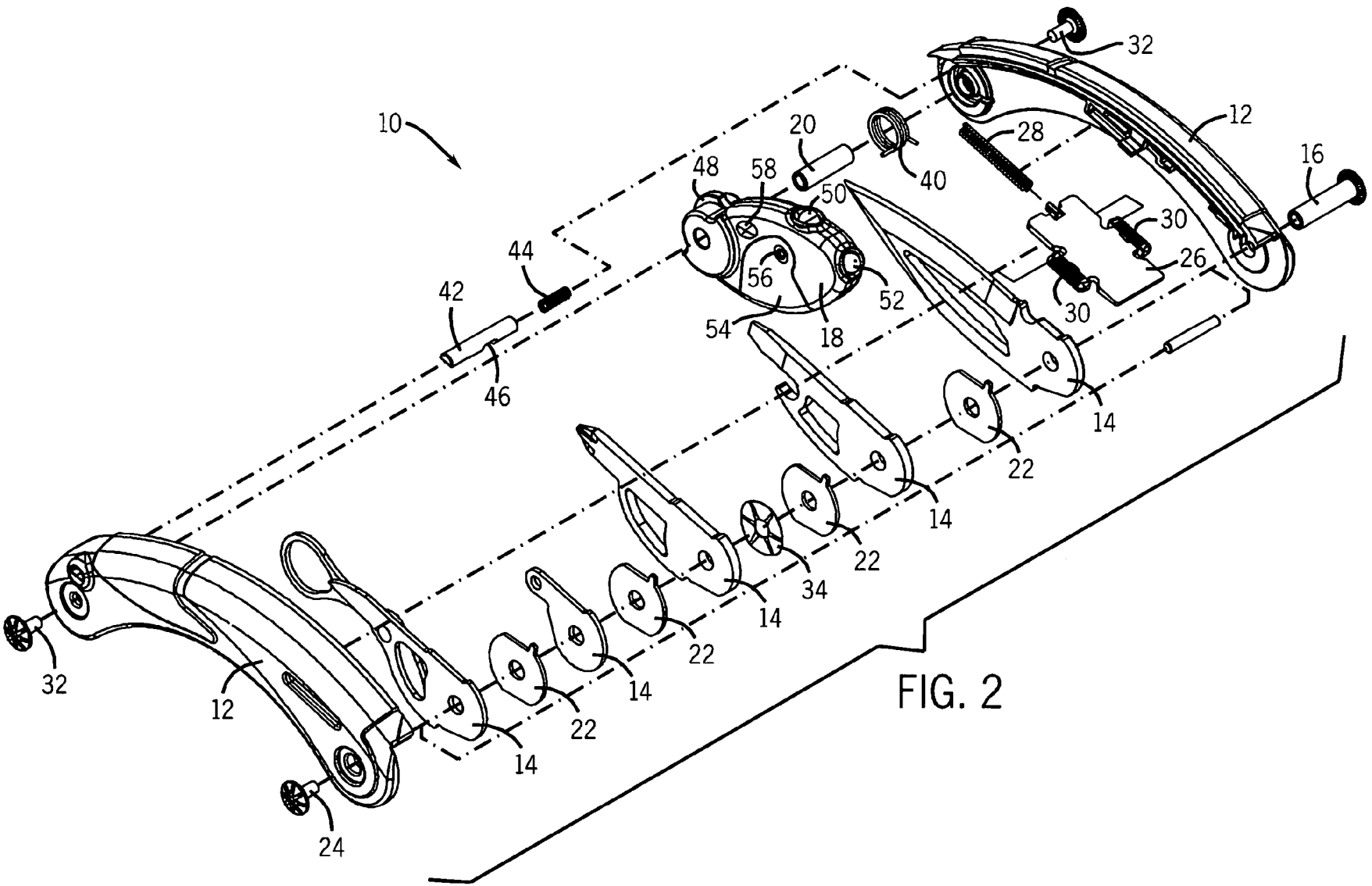
FIG. 2 is an exploded view of a pocket tool having a flashlight.

Referring to FIG. 2, according to an exemplary embodiment, pocket tool 10 may include a number of ancillary tools 14, such as a pair of scissors, a lanyard, screwdrivers, a bottle opener, and a knife blade among other types of tools known in the art. The ancillary tools 14 may be separated by spacers 22, which may be prevented from rotating by interaction with the handle 12, such that the opening of one ancillary tool 14 does not cause rotation of adjacent ancillary tools 14. Adjacent one or more of the ancillary tools 14 or spacers 22 may be a wave disk 34, which is a type of compression spring that aides in maintaining the proper compression between the ancillary tools 14 during wear of the tool 10. Ancillary tools 14 and spacers 22 may be attached to the handle 12 by axle 16, which is secured by an axle locking pin 24.

Further referring to FIG. 2, ancillary tools 14 may be locked into the open position by a locking mechanism, shown as wedge lock 26. Wedge lock is biased into a locking position by a spring 28 and further includes engagement surfaces, shown as wings 30 (see also FIGS. 1 and 4) that extend through corresponding slots in the handle 12 to allow the user to disengage the wedge lock 28 to unlock ancillary tools 14 that are locked in the open position. A typical wedge lock design is shown and described in U.S. Pat. No. 6,625,832 to Montague et al.

Still referring to FIG. 2, flashlight 18 is coupled to handle 12 by axle 20, which is secured by a pair of axle locking pins 32. The flashlight 18 is pivotally coupled to axle 20 such that it can be folded into a stored position within the handle 12 (see FIG. 1) and outward into an open position for use (see FIG. 4). In an exemplary embodiment, the flashlight 18 is biased into the open position by a bias mechanism, shown as pivot spring 40, which is shown as a torsion spring but could be another type of bias mechanism that is known in the art, such as a coil or leaf spring.

In an exemplary embodiment, a pivot latch pin 42 is used to maintain the flashlight 18 in the closed position until its desired engagement by the user. The pivot latch pin 42 serves as a means for activating the flashlight 18. By depressing the portion of the pivot latch pin 42 that extends out of the handle 12 (see FIG. 1) the user activates the flashlight 18 by permitting the bias mechanism to move the flashlight from the closed position into the open position. A pivot latch spring, shown as coil spring 44, biases the pivot latch pin 42 in a locking position.

According to an exemplary embodiment, although the flashlight 18 is biased in the opening direction by pivot spring 40, interaction between the pivot latch pin 42 and a corresponding ridge 48 on the flashlight 18 maintains the flashlight 18 in the closed position until the user depresses pivot latch pin 42, thus sliding pivot latch pin 42 with respect to ridge 48 until ridge 48 matches up with notch 46 in the pivot latch pin 42, permitting ridge 48 to slide through notch 46 thus allowing flashlight 18 to rotate into the open position.

Figure 3:
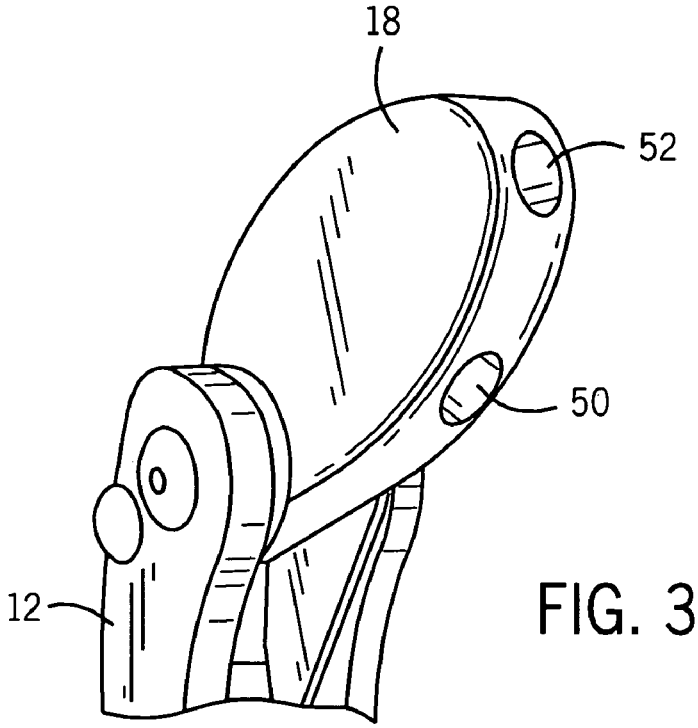
FIG. 3 is a partial view of a flashlight attached to a handle.
Figure 4:
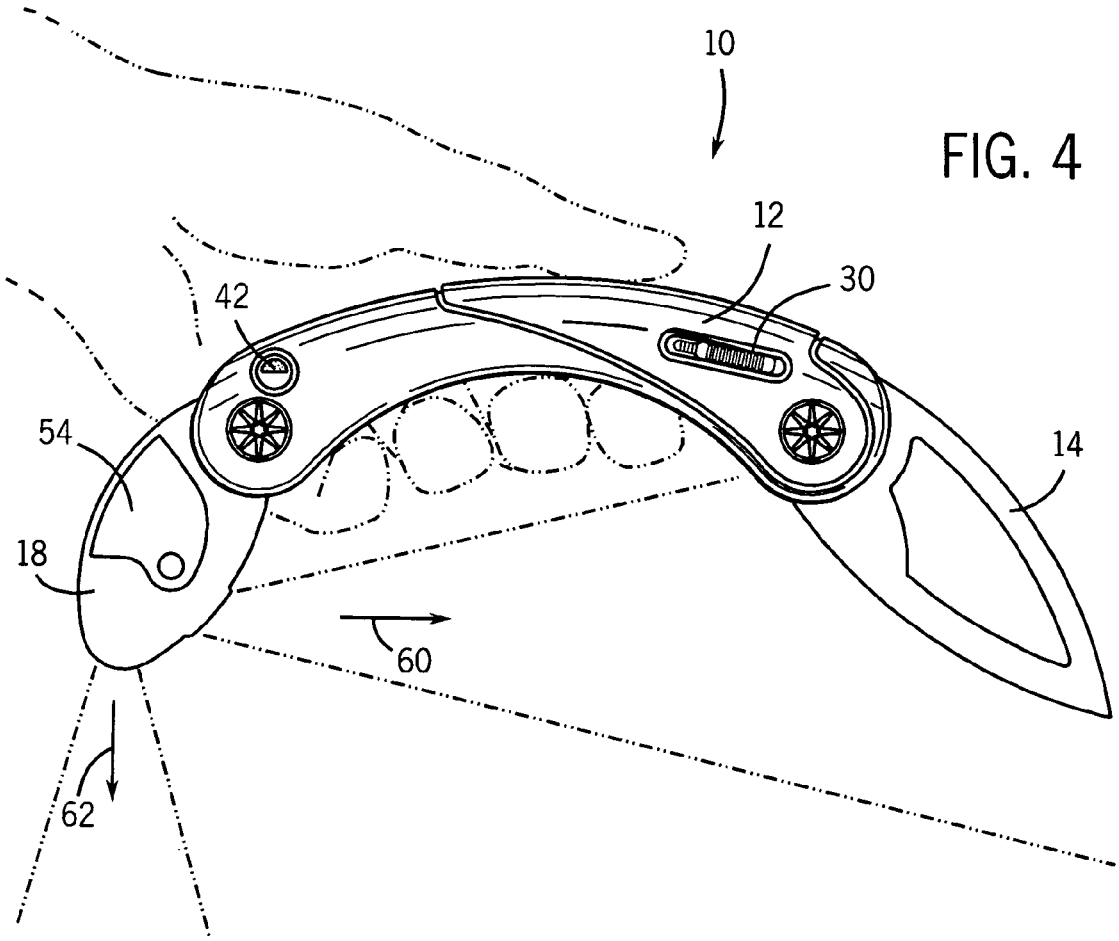
FIG. 4 is an elevation view of a pocket tool having a knife and a flashlight in the extended open position.

Referring to FIG. 3, flashlight 18 includes two light sources, shown schematically as light-emitting diodes (LEDs) 50, 52. In other embodiments, the light sources may be incandescent bulbs or other types of light sources known in the flashlight art. Further, each light source may have a corresponding lens and reflector, depending on the type of light source, as is also known in the art. In the embodiment shown in FIG. 3, the flashlight 18 includes a battery case within the unit, generally inside cover 54 (see FIG. 2), which is held in place by screw 56 (see FIG. 2). In one embodiment, the flashlight 18 is powered by two lithium batteries. The exterior structure of the flashlight 18 shown in FIGS. 2–4 is intended to be only one example of many possible structures available in the context of the present invention. General design considerations may include the ability to receive the flashlight within the handle 12 when in the closed position and the ability to rotate the flashlight into an open position in an efficient manner.

Referring to FIG. 4, in a preferred embodiment, flashlight 18 shines two beams of light (shown generally by arrows 60, 62 between broken lines in FIG. 4) in different directions. The first beam 60 is intended to light the ancillary tool 14 being used thus providing task lighting. Note how when the flashlight 18 is in the open position, the first beam 60 shines past a user's fingers without obstruction to shine on the tool 14 in use. This advantage is realized because the flashlight 18 rotates away from the handle 12 when placed into use, thus providing clearance for the light beam 60. The curved handle shape also aids in this respect. The second beam 62 shines in a different direction, in the present embodiment approximately ninety degrees away from the first beam 60, although different spacings may be used. The second beam 62 may be intended to light a worksurface. The use of different LEDs or lenses may permit the light beams to be of different colors or intensities depending on the desired design and function of the pocket tool 10.

Further referring to FIG. 4, another useful result of having two light beams shining from flashlight 18 in two different directions occurs when using the tool 10 to navigate in the dark. In this situation, the first light beam 60 may be used to shine in a forward direction, and the second light beam 62 may shine in a downward direction, illuminating the ground in front of the user's feet, thus identifying tripping hazards and so forth. The tool 10 may be held in the reverse position in the user's hand (relative to the position shown in FIG. 4) to most effectively use this feature. The usefulness of the multiple light beams extends beyond the use in a pocket tool having ancillary tools to general applicability in the flashlight art as well.

In a preferred embodiment, the flashlight 18 does not have a button or switch requiring manual interaction by the user to turn on the flashlight. Rather, the flashlight 18 is designed to automatically turn on when it rotates into the open position. Therefore, with one action, such as depressing the pivot latch pin 42, the user may open and turn on the flashlight 18. The auto-on feature may be effectuated by having electrical contacts in the handle that complete a lighting circuit only when the flashlight is in the open position.

In another preferred embodiment, the flashlight 18 includes a microprocessor (not shown) that controls the various modes of the flashlight 18. In this embodiment, a push switch 58 (see FIG. 2) may be utilized. As an example, depressing switch 58 once may activate a first light source, such as LED 52, depressing switch 58 twice may activate a second light source, such as LED 50, depressing switch 58 three times may activate both light sources 50, 52, and depressing switch 58 four times may activate both light sources 50, 52, but have a primary light source, such as LED 52, blink. Depressing the switch 58 again may turn off the flashlight 18 entirely. Of course, utilizing a microprocessor permits many different ways of activating the various light sources available on the flashlight, including activating different intensities, colors, and modes, such as a blinking mode, and so forth.

While the detailed drawings and specific examples given describe various exemplary embodiments, they serve the purpose of illustration only. It is to be understood that the invention is not limited in its application to the details of construction and the arrangements of components set forth in the preceding description or illustrated in the drawings. For example, the multiple light beams emitted by the flashlight may be configured to shine in different directions depending on the type of tool. Further, rather than utilizing the flashlight solely in connection with a pocket tool having ancillary tools, the multiple beam flashlight concept may be used separately as part of a stand-alone flashlight having a handle and a lighting unit with multiple light sources. Furthermore, other substitutions, modifications, changes, and omissions may be made in the design, operating conditions, and arrangements of the exemplary embodiments without departing from the scope of the invention as expressed in the appended claims.

What is claimed is:

1. A pocket tool, comprising:

a curved handle having a first end and a second end distal to the first end, said curved handle further having an inner curved surface and an outer curved surface, said inner and outer curved surfaces defining a curvature of the curved handle, said inner curved surface including an inner channel;

at least one ancillary tool pivotally coupled to the handle at a position proximate to the first end and configured to be at least partially received by the inner channel when the ancillary tool is in a stowed position; and a flashlight pivotally coupled to the handle at a position proximate to the second end of the handle, the flashlight having a first light source directed in a first direction such that the first light source lights the ancillary tool when both the flashlight and the ancillary tool are in open positions and a second light source directed in a second direction;

wherein the inner curved surface is intended to receive a user's fingers when the pocket tool is in use; and wherein the curved handle has sufficient curvature to allow light from the first light source to illuminate the ancillary tool without the light being blocked by the intended user's fingers.

2. The pocket tool of claim 1, wherein the first and second directions are approximately ninety degrees apart.

3. The pocket tool of claim 1, wherein the first and second light sources are LEDs.

4. The pocket tool of claim 1, wherein the ancillary tool is a knife, a bottle opener, a screwdriver, or a pair of scissors.

5. The pocket tool of claim 1, wherein the flashlight is stowed in the inner channel when the flashlight is in a closed position.

6. A pocket tool, comprising:

a handle having a first end and a second end distal to the first end;

an ancillary tool coupled to the handle at a position proximate to the first end;

a flashlight pivotally coupled to the handle at a position proximate to the second end of the handle, the flashlight having a closed position and a fully extended position;

a means for biasing the flashlight into the fully extended position coupled between the handle and the flashlight;

wherein the handle has a generally curved shape defined by an inner curved surface and an outer curved surface, said inner curved surface being intended to contact a user's fingers when the pocket tool is in use, and said inner curved surface including an inner channel for at least partially receiving the ancillary took; and wherein the handle has a sufficient curvature to allow light from the flashlight to illuminate the ancillary tool without the light being blocked by the intended user's fingers positioned along the inner curved surface when the flashlight is in the fully extended position.

7. The pocket tool of claim 6, wherein the flashlight comprises two light beams shining in two different directions.

8. The pocket tool of claim 7, wherein the two different directions are approximately ninety degrees apart.

9. The pocket tool of claim 7, wherein the two light beams are generated by LEDs.

10. The pocket tool of claim 6, wherein the ancillary tool is a knife, a bottle opener, a screwdriver, or a pair of scissors.

11. The pocket tool of claim 6, wherein the flashlight is stowed in the inner channel when the flashlight is in a closed position.

12. The pocket tool of claim 6, wherein the means for biasing is a torsion spring.

13. A flashlight, comprising:

a handle having an inner curved surface and an outer curved surface said inner and outer curved surfaces define a curvature of the curved handle and said inner curved surface being intended to contact a user's fingers when the pocket tool is in use;

a lighting unit pivotally coupled to the handle;

a first light source coupled to the lighting unit, the first light source directing a first light beam in a first direction;

a second light source coupled to the lighting unit, the second light source directing a second light beam in a second direction; and wherein the curved handle has a sufficient curvature to allow light from the first light source to illuminate the ancillary tool without the light being blocked by the intended user's fingers positioned alone the inner curved surface.

14. The flashlight of claim 13, wherein the first and second directions are approximately ninety degrees apart.

15. The flashlight of claim 13, wherein the first and second light sources are LEDs.

16. The flashlight of claim 13, further comprising an ancillary tool pivotally coupled to the handle.

17. The flashlight of claim 16, wherein the ancillary tool is a knife, a bottle opener, a screwdriver, or a pair of scissors.

18. The flashlight of claim 13, further comprising a means for activating the flashlight, wherein when the means for activating the flashlight is engaged, the means for biasing the flashlight moves the flashlight from the closed position to the open position and the flashlight is turned on.

* * * * *

UNITED STATES PATENT AND TRADEMARK OFFICE

CERTIFICATE OF CORRECTION

PATENT NO. : 7,063,435 B2
APPLICATION NO. : 10/716387
DATED : June 20, 2006
INVENTOR(S) : Edgar A. Dallas and John A. Nason It is certified that error appears in the above-identified patent and that said Letters Patent is hereby corrected as shown below:

Column 5:
Line 54, replace “took” with --tool--.

Column 6:
Line 37, replace “alone” with --along--.

Signed and Sealed this

Fourteenth Day of November, 2006

JON W. DUDAS
*Director of the United States Patent and Trademark Office*